US008299005B2

(12) United States Patent
Poirier et al.

(10) Patent No.: US 8,299,005 B2
(45) Date of Patent: Oct. 30, 2012

(54) LUBRICATING OIL COMPOSITION

(75) Inventors: Marc-Andre Poirier, Sarnia (CA); Douglas E. Deckman, Mullica Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 850 days.

(21) Appl. No.: 11/800,602

(22) Filed: May 7, 2007

(65) Prior Publication Data

US 2007/0265176 A1 Nov. 15, 2007

Related U.S. Application Data

(60) Provisional application No. 60/798,941, filed on May 9, 2006.

(51) Int. Cl.
*C10M 129/76* (2006.01)
*C10M 135/18* (2006.01)

(52) U.S. Cl. ..... 508/501; 508/459; 508/363

(58) Field of Classification Search ..... 508/459, 508/501, 363
See application file for complete search history.

(56) References Cited

U.S. PATENT DOCUMENTS

| | | | | |
|---|---|---|---|---|
| 4,683,069 | A | 7/1987 | Brewster et al. | |
| 5,064,546 | A | 11/1991 | Dasai | |
| 5,356,547 | A | 10/1994 | Arai et al. | |
| 5,458,807 | A | 10/1995 | Tamoto | |
| 5,906,969 | A | 5/1999 | Fyfe | |
| 6,074,993 | A | 6/2000 | Waddoups et al. | |
| 6,268,316 | B1 | 7/2001 | Tanaka et al. | |
| 2003/0166473 | A1 | 9/2003 | Deckman et al. | |
| 2003/0166474 | A1 | 9/2003 | Winemiller et al. | |
| 2004/0043910 | A1 * | 3/2004 | Lok et al. | 508/575 |
| 2005/0261146 | A1 * | 11/2005 | Rosenbaum et al. | 508/466 |
| 2006/0172898 | A1 * | 8/2006 | Roby et al. | 508/485 |
| 2006/0196807 | A1 * | 9/2006 | Rosenbaum et al. | 208/19 |
| 2006/0205615 | A1 * | 9/2006 | Esche, Jr. | 508/418 |
| 2006/0276351 | A1 * | 12/2006 | Mucha et al. | 508/199 |

FOREIGN PATENT DOCUMENTS

| | | | |
|---|---|---|---|
| EP | 0 208 541 | B1 | 4/1991 |
| EP | 0 737 735 | A2 | 10/1996 |
| EP | 1 299 509 | B1 | 8/2004 |
| EP | 1 652 908 | A1 | 5/2006 |
| EP | 1 688 476 | A1 | 8/2006 |
| WO | WO 96/19551 | | 6/1996 |
| WO | WO 01/59037 | A2 | 8/2001 |
| WO | WO 01/79399 | A1 | 10/2001 |
| WO | WO 01/88067 | A2 | 11/2001 |
| WO | WO 03/064569 | A1 | 8/2003 |
| WO | WO 03/064572 | A1 | 8/2003 |

* cited by examiner

*Primary Examiner* — Jim Goloboy
(74) *Attorney, Agent, or Firm* — Robert H. Migliorini

(57) ABSTRACT

A lubricating composition is provided that has good elastomer compatibility and friction-reduced properties which comprises a base oil having a viscosity index (VI) greater than about 80, a kinematic viscosity (Kv) at 100° C. of from about 2 $mm^2/s$ to about 50 $mm^2/s$, containing 90 wt % or more saturates, having less than about 5 ppm sulfur, and wherein the base oil is derived from a waxy feed; said composition being free of a tallow diaminepropane dioleate; and containing a minor amount of (a) a polylester of an aliphatic carboxylic acid having 12 to 24 carbon atoms and (b) an oil soluble or oil dispersible molybdenum compound.

3 Claims, No Drawings

LUBRICATING OIL COMPOSITION

This application claims priority of Provisional Application 60/798,941 filed May 9, 2006.

FIELD OF THE INVENTION

The present invention relates generally to lubricating oil compositions. More particularly, the invention relates to improving the friction reducing properties, among others, of lubricating oil compositions which utilize as the base oil highly paraffinic oils derived from waxy feeds and a combination of friction modifiers.

BACKGROUND OF THE INVENTION

In recent years, the specifications for finished lubricants require oil formulators to develop finished lubricants that contain less phosphorous while also providing reduced mechanical wear and increased lubricant life spans. Moreover, while lubricant performance specifications have been increased, the treat rate for lubricant additives has been decreased. Also required is a reduction in mechanical friction so as to meet energy saving trends.

A wide variety of compounds for use as lubricating oil friction modifiers are known. These include nitrogen containing compounds such as amines, imines and amides, oxygen containing compounds such as fatty acids and full or partial esters thereof, and oil soluble or oil dispersible molybdenum compounds such as dinuclear molybdenum dialkyldithiocarbamates and trinuclear organomolybdenum compounds, to mention but a few.

Often combinations of specific additives are reported to produce synergistic effects, and in some cases, a change in the concentration of the combined additives reverses the overall effect. Additionally, it has been observed that the overall effect of additives depends not only on the nature and concentration of the additives, but on the nature of the oil as well. The invention disclosed herein lends support to the observation that the base oil of a lubricant formulation may have an influence on additive performance, especially a dual additive in a complex mixture.

SUMMARY OF THE INVENTION

In one embodiment of the invention there is provided a lubricant composition comprising a major amount of a base oil having a viscosity index (VI) greater than about 120, a kinematic viscosity (Kv) at 100° C. of from about 2 $mm^2/s$ to about 50 $mm^2/s$, containing 95 wt % or more saturates, having less than about 5 ppm sulfur, and wherein the base oil is derived from a waxy feed; and a minor amount of (a) a polyol ester of an aliphatic carboxylic acid having 12 to 24 carbon atoms, and (b) an oil soluble or oil dispersible molybdenum compound.

In another embodiment of the invention there is provided a method for making a lubricant composition comprising incorporating in a base oil having a viscosity index (VI) greater than about 120, a kinematic viscosity (Kv) at 100° C. of from about 2 $mm^2/s$ to about 50 $mm^2/s$, containing 95 wt % or more saturates, having less than about 5 ppm sulfur, and wherein the base oil is derived from a waxy feed; and a minor amount of:

(a) a polyol ester of an aliphatic carboxylic acid having 12 to 24 carbon atoms, and (b) an oil soluble or oil dispersible molybdenum compound whereby the composition has an increased film thickness and lower friction coefficient compared to a composition prepared from a polyolefin (PAO) base oil and (a) and (b).

Other embodiments will become apparent from the detailed description of the invention.

DETAILED DESCRIPTION OF THE INVENTION

The compositions of the present invention comprise a major amount of a base oil having a VI greater than about 120, preferably greater than 125 and more preferably greater than 130. References herein to VI refer to ASTM test method D 2270.

The base oil generally will have a Kv at 100° C. of from about 2 $mm^2/s$ to about 50 and preferably from about 3.5 cSt to about 30 as measured by ASTM test method D 445.

In addition, the base oils are highly paraffinic, i.e., they have greater than about 95 wt % saturates and preferably greater than 98 wt % saturates and may contain mixtures of monocycloparaffin and multicycloparaffins in combination with noncyclic isoparaffins.

Suitable base oils include one or more of a mixture of base stock(s) derived from one or more GTL materials as well as isomerate/isodewaxate base stock(s) derived from natural wax or waxy feeds, mineral and or non-mineral waxy feed stocks such as slack waxes, waxy hydrocracker bottoms, hydrocrackate, thermal crackates and even waxy materials received from coal liquification or shale oil and mixtures of such base stocks.

As used herein, the following terms have the indicated meanings:

(a) "wax"—hydrocarbonaceous material having a high pour point, typically existing as a solid at room temperature, i.e., at a temperature in the range from about 15° C. to 25° C., and consisting predominantly of paraffinic materials;

(b) "paraffinic" material: any saturated hydrocarbons, such as alkanes. Paraffinic materials may include linear alkanes, branched alkanes (iso-paraffins), cycloalkanes (cycloparaffins; mono-ring and/or multi-ring), and branched cycloalkanes;

(c) "hydroprocessing": a refining process in which a feedstock is heated with hydrogen at high temperature and under pressure, commonly in the presence of a catalyst, to remove and/or convert less desirable components and to produce an improved product;

(d) "hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;

(e) "hydrodewaxing" (or catalytic dewaxing): a catalytic process in which normal paraffins (wax) and/or waxy hydrocarbons are converted by cracking/fragmentation into lower molecular weight species, and by rearrangement/isomerization into more branched iso-paraffins;

(f) "hydroisomerization" (or isomerization or isodewaxing): a catalytic process in which normal paraffins (wax) and/or slightly branched isoparaffins are converted by rearrangement/isomerization into more branched isoparaffins;

(g) "hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

The term "hydroisomerization/hydrodewaxing" is used to refer to one or more catalytic processes which have the combined effect of converting normal paraffins and/or waxy hydrocarbons by cracking/fragmentation into lower molecular weight species and, by rearrangement/isomerization, into more branched iso-paraffins. Such combined processes are sometimes described as "catalytic dewaxing" or "selective hydrocracking".

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from GTL materials such as by, for example, distillation or thermal diffusion, and subsequently subjected to well-known catalytic or solvent dewaxing processes to produce lube oils of reduced/low pour point; wax isomerates, comprising, for example, hydroisomerized or isodewaxed synthesized hydrocarbons; hydroisomerized or isodewaxed Fischer-Tropsch (F-T) material (i.e., hydrocarbons, waxy hydrocarbons, waxes and possible analogous oxygenates); preferably hydroisomerized or isodewaxed F-T hydrocarbons or hydroisomerized or isodewaxed F-T waxes, hydroisomerized or isodewaxed synthesized waxes, or mixtures thereof.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

Isomerate/isodewaxate base stock(s), derived from waxy feeds, which are also suitable for use in this invention, are paraffinic fluids of lubricating viscosity derived from hydroisomerized or isodewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stocks and base oils.

Slack wax is the wax recovered from petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane.

Slack wax(es), being secured from petroleum oils, may contain sulfur and nitrogen containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a dumbbell blend wherein the blend exhibits a viscosity within the aforesaid recited range.

In a preferred embodiment, the GTL material, from which the GTL base stock(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high alpha for producing the more desirable higher molecular weight paraffins. This process is also well known to those skilled in the art.

In an F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but which is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for an F-T synthesis reaction is 2.0, but there are many reasons for using other than a stoichiometric ratio as those skilled in the art know. In cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. The term "$C_{5+}$" is used herein to refer to hydrocarbons with a carbon number of greater than 4, but does not imply that material with carbon number 5 has to be present. Similarly other ranges quoted for carbon number do not imply that hydrocarbons having the limit values of the carbon number range have to be present, or that every carbon number in the quoted range is present. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise Titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which the base stock(s) is/are derived is wax or waxy feed from mineral oil, non-mineral oil, non-petroleum, or other natural source, especially slack wax, or GTL material, preferably F-T material, referred to as F-T wax. F-T wax preferably has an initial boiling point in the range of from 650-750° F. and preferably continuously boils up to an end point of at least 1050° F. A narrower cut waxy feed may also be used during the hydroisomerization. A portion of the n-paraffin waxy feed is converted to lower boiling isoparaffinic material. Hence, there must be sufficient heavy n-paraffin material to yield an isoparaffin containing isomerate boiling in the lube oil range. If catalytic dewaxing is also practiced after isomerization/isodewaxing, some of the isomerate/isodewaxate will also be hydrocracked to lower boiling material during the conventional catalytic dewaxing. Hence, it is preferred that the end boiling point of the waxy feed be above 1050° F. (1050° F.+).

When a boiling range is quoted herein it defines the lower and/or upper distillation temperature used to separate the fraction. Unless specifically stated (for example, by specifying that the fraction boils continuously or constitutes the entire range) the specification of a boiling range does not require any material at the specified limit has to be present, rather it excludes material boiling outside that range.

The waxy feed preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F.$^-$ fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, e.g., slack wax or F-T wax, may be characterized as a hydrodewaxing process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization/hydrodewaxing catalyst used in subsequent steps. If F-T waxes are used, such preliminary treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from removal of oxygenates while others may benefit from oxygenates treatment. The hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Following any needed hydrodenitrogenation or hydrodesulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking/hydroisomerized/isodewaxing GTL materials and/or waxy materials to base stock or base oil are described, for example, in U.S. Pat. Nos. 2,817,693; 4,900,407; 4,937,399; 4,975,177; 4,921,594; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099; 6,025,305; 6,080,301; 6,096,940; 6,620,312; 6,676,827; 6,383,366; 6,475,960; 5,059,299; 5,977,425; 5,935,416; 4,923,588; 5,158,671; and 4,897,178; EP 0324528 (B1), EP 0532116 (B1), EP 0532118 (B1), EP 0537815 (B1), EP 0583836 (B2), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359; WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974; and 6,375,830.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269. The use of the Group VIII metal loaded ZSM-48 family of catalysts, preferably platinum on ZSM-48, in the hydroisomerization of the waxy feedstock eliminates the need for any subsequent, separate dewaxing step, and is preferred.

A dewaxing step, when needed, may be accomplished using either well known solvent or catalytic dewaxing processes and either the entire hydroisomerate or the 650-750° F.+ fraction may be dewaxed, depending on the intended use of the 650-750° F.− material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Low molecular weight hydrocarbons, such as propane, are also used for dewaxing, in which the hydroisomerate is mixed with liquid propane, a least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention. Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stock(s), isomerized or isodewaxed wax-derived base stock(s), have a beneficial kinematic viscosity advantage over conventional Group II and Group III base stocks and base oils, and so may be very advantageously used with the instant invention. Such GTL base stocks and base oils can have significantly higher kinematic viscosities, up to about 20-50 $mm^2/s$ at 100° C., whereas by comparison commercial Group II base oils can have kinematic viscosities, up to about 15 $mm^2/s$ at 100° C., and commercial Group III base oils can have kinematic viscosities, up to about 10 $mm^2/s$ at 100° C. The higher kinematic viscosity range of GTL base stocks and base oils, compared to the more limited kinematic viscosity range of Group II and Group III base stocks and base oils, in combination with the instant invention can provide additional beneficial advantages in formulating lubricant compositions.

In the present invention the one or more isomerate/isodewaxate base stock(s), the GTL base stock(s), or mixtures thereof, preferably GTL base stock(s) can constitute all or part of the base oil.

One or more of the wax isomerate/isodewaxate base stocks and base oils can be used as such or in combination with the GTL base stocks and base oils.

One or more of these waxy feed derived base stocks and base oils, derived from GTL materials and/or other waxy feed materials can similarly be used as such or further in combination with other base stocks and base oils of mineral oil origin, natural oils and/or with synthetic base oils.

The preferred base stocks or base oils derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

The GTL base stock/base oil and/or wax hydroisomerate/isodewaxate, preferably GTL base oils/base stocks obtained from F-T wax, more preferably GTL base oils/base stocks obtained by the hydroisomerization/isodewaxing of F-T wax, can constitute from 5 to 100 wt %, preferably 40 to 100 wt %, more preferably 70 to 100 wt % by weight of the total of the base oil, the amount employed being left to the practitioner in response to the requirements of the finished lubricant.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_2 \geqq 4)>15$; and (b) $BI+0.85(CH_2 \geqq 4)<45$ as measured over said liquid hydrocarbon composition as a whole.

The preferred GTL base oil can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred BI≧25.4 and ($CH_2$≧4)≦22.5. They have a nominal boiling point of 370° C.$^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV @ 100° C.)-7000.

The preferred GTL base oil is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2$≧4), and Free Carbon Index (FCI) are determined as follows:

Branching Index

A 359.88 MHz 1H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the α-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2$≧4)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ≈29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a) calculate the average carbon number of the molecules in the sample which is accomplished with sufficient accuracy for lubricating oil materials by simply dividing the molecular weight of the sample oil by 14 (the formula weight of $CH_2$);

b) divide the total carbon-13 integral area (chart divisions or area counts) by the average carbon number from step a. to obtain the integral area per carbon in the sample;

c) measure the area between 29.9 ppm and 29.6 ppm in the sample; and d) divide by the integral area per carbon from step b. to obtain FCI.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

GTL base oils and base oils derived from synthesized hydrocarbons, for example, hydroisomerized or isodewaxed waxy synthesized hydrocarbon, e.g., Fischer-Tropsch waxy hydrocarbon base oils are of low or zero sulfur and phosphorus content. There is a movement among original equipment manufacturers and oil formulators to produce formulated oils of ever increasingly reduced sulfur, sulfated ash and phosphorus content to meet ever increasingly restrictive environmental regulations. Such oils, known as low SAP oils, would rely on the use of base oils which themselves, inherently, are of low or zero initial sulfur and phosphorus content. Such oils when used as base oils can be formulated with the catalytic antioxidant additive disclosed herein replacing or used part of the heretofore additive such as ZDDP previously employed in stoichimetric or super stoichiometric amounts. Even if the remaining additive or additives included in the formulation contain sulfur and/or phosphorus the resulting formulated oils will be lower or low SAP.

The base oils of the composition of the present invention may contain from about 4 to about 10 wt % of a PAO or an API Group V oil, the amount being based on the total weight of the base oil. The preferred PAOs are those prepared by C8 to C12 monoolefins. The preferred API Group V oil is an alkylated aromatic, preferably a long chain (10 to 18 carbon atoms) alkylated aromatic such as alkylated naphthalenes.

The compositions of the invention will include a minor amount of (a) a polyol ester of an aliphatic carboxylic acid having 12 to 24 carbon atoms and (b) an oil soluble or oil dispersible molybdenum compound.

Polyols include diols, triols and the like, such as ethylene glycol, propylene glycol, glycerol, sorbitol, to mention a few. In the present invention the esters of these polyols are those of carboxylic acids having 12 to 24 carbon atoms. Examples of such carboxylic acids include octadecanoic acid, dodecanoic acid, stearic acid, lauric acid and oleic acid.

The esters used in the present invention may be mixtures of mono-, di- and triesters but preferably are predominantly the monoesters. A preferred ester is glycerol mono-octadecanoate, which is commercially available from Uniqema Chemie BV, The Netherlands, as Perfad FM 3336. If mixtures of mono-, di- and triesters are used, then such mixtures preferably will contain greater than 50 mole % of the monoester, from 0 mole % to about 20 mole % of the triester, with the balance being the diester.

The amount of polyol ester in the compositions of the invention is typically 0.1 wt % to 1.0 wt % and preferably 0.5 wt % to 0.6 wt %, based on the total weight of the lubricant composition.

For the lubricating oils of this invention any suitable oil soluble or oil dispersible organomolybdenum compound having friction modifying and/or antiwear properties in lubricating compositions may be used. As an example of such compounds, there may be mentioned the molybdenum dithiocarbamates, dialkyldithiophosphates, alkylthioxanthates and alkylthioxanthates.

The molybdenum compound may be mono-, di-, tri- or tetra-nuclear. Dinuclear and trinuclear compounds are preferred. Most preferably, the molybdenum compound is a molybdenum dithiocarbamate that can be represented by the formula $MO_2O_xS_{4-x}L_2$ where L is a dialkyldithiocarbamate and x is an integer from 0 to 4. In the ligand, L, the dialkyl group will have from 4 to 24 carbon atoms and preferably 6 to 18 carbon atoms.

The amount of the molybdenum compound in the compositions of the invention typically will be 0.05 wt % to 1.0 wt % based on the total weight of the lubricant composition.

The composition of the invention may include one or more lubricant additives such as dispersants, detergents, antioxidants, pour point depressants, VI improvers, rust inhibitors and antifoamants.

Useful dispersants are borated and nonborated nitrogen containing compounds made from high molecular weight mono- and dicarboxylic acids and amines. Dispersants are generally used in amounts from about 0.5 to 10 wt % based on the total weight of the lubricating composition.

Useful detergents include calcium or magnesium salicylates or phenates. They are generally used in amounts from 0.5 to about 6 wt % based on the total weight of the lubricating composition.

Suitable VI improvers are those normally used in lubricating oils such as polybutene polymers, ethylene propylene copolymer, alkyl acrylate esters, polymethacrylate esters, A-B block copolymer such as those made by polymerization of dienes such as butadiene and/or isoprene with vinyl aromatics such as styrene and the like. These additives are used in amounts of from 1.5 to 15 wt % based on the total weight of the composition.

From the foregoing, it should be apparent that the optional useful additives are conventional lubricant additives used in conventional amounts.

The compositions of the invention may be formulated in any viscometric form, i.e., they may be formulated as a single grade oil or as multigrade oil such as SAE 0W-20, 0W-30, 0W-40, 5W20, 5W-30, 5W-40, 10W30 and the like.

The invention is further illustrated by the following examples.

Example 1

Three 0W-30 engine lubricants were formulated with PAO 4, and three 0W-30 engine lubricants were formulated with a GTL oil, i.e., a hydroisomerized F-T base oil, using conventional additives at the same treat rate in all instances. All the lubricants contained the same molybdenum dithiocarbamate at the same treat rate. The compositional differences involved the presence or absence of glycerol stearate and Doumeen TDO, an a N-tallow-1,3-diaminopropane dioleate sold by AKZO Nobel, The Netherlands. The compositions of the various formulations and their properties are shown in Table 1.

TABLE 1

| | Fluid 1 wt % | Fluid 2 wt % | Fluid 3 wt % | Fluid 4 wt % | Fluid 5 wt % | Fluid 6 wt % |
|---|---|---|---|---|---|---|
| Components | | | | | | |
| PAO 4 | 70.39 | 0 | 70.39 | 0 | 70.39 | 0 |
| GTL 3.6 | 0 | 70.39 | 0 | 70.39 | 0 | 70.39 |
| Additives | 28.86 | 28.86 | 28.86 | 28.86 | 28.86 | 28.86 |
| Glycerol mono-octadecanoate | 0.55 | 0.55 | 0 | 0 | 0.275 | 0.275 |
| Mo Dithiocarbamate | 0.20 | 0.20 | 0.20 | 0.20 | 0.2 | 0.2 |
| Duomeen TDO | 0 | 0 | 0.55 | 0.55 | 0.275 | 0.275 |
| Properties | | | | | | |
| Viscosity @ 40° C., $mm^2/s$ | 60.79 | 50.36 | 60.73 | 50.48 | 60.59 | 50.40 |
| Viscosity @ 100° C., $mm^2/s$ | 11.1 | 10.15 | 11.12 | 10.18 | 11.10 | 10.16 |
| VI | 178 | 195 | 178 | 195 | 180 | 195 |
| CCS @ −35° C., cP | 3940 | 3140 | 3840 | 3010 | 3860 | 2820 |
| Boron, wppm | 68 | 67 | 67 | 67 | 68 | 68 |
| Calcium, wppm | 2320 | 2290 | 2250 | 2260 | 2310 | 2290 |
| Molybdenum, wppm | 91 | 90 | 91 | 91 | 89 | 93 |
| Zinc, wppm | 746 | 736 | 734 | 739 | 737 | 752 |

Example 2

The friction reduction performance of the fluids of Table 1 was evaluated by the High Frequency Reciprocating Rig (HFRR). The results are given in Table 2.

TABLE 2

| HFRR | | Fluid 1 | Fluid 2 | Fluid 4 | Fluid 5 | Fluid 6 |
|---|---|---|---|---|---|---|
| 0.4 Kg/60 Hz, 1.0 mm 60° C. to 180° C. | Ave Friction | 0.092 | 0.082 | 0.083 | 0.085 | 0.082 |
| | % Ave Film | 79.5 | 87.6 | 100.6 | 91.1 | 89.2 |
| Scar Ave (μm) | | 140 | 138 | 149 | 158 | 142 |

As can be seen, Fluid 2, a composition of the invention, produces higher film thickness and lower friction coefficient than Fluid 1, a formulation having the same additives but different base oil.

Example 4

The fluids of Table 1 were subjected to the DC AK6 seal compatibility test under the following conditions:

| Test Conditions: | |
|---|---|
| Temperature: | 150° C. |
| Immersion: | VDA 675301 |
| Immersion: | Closed test cup |
| Dumb-bell: | S2 according to DIN 53 504 |
| Test Speed: | 200 mm/min. |

The results are given in Table 3.

TABLE 3

| Components | Fluid 1 wt % | Fluid 2 wt % | Fluid 3 wt % | Fluid 4 wt % | Fluid 5 wt % | Fluid 6 wt % | Specs. |
|---|---|---|---|---|---|---|---|
| PAO 4 | 70.39 | 0 | 70.39 | 0 | 70.39 | 0 | |
| GTL 3.6 | 0 | 70.39 | 0 | 70.39 | 0 | 70.39 | |
| Additives | 28.86 | 28.86 | 28.86 | 28.86 | 28.86 | 28.86 | |
| Glycerol mono-octadecanoate | 0.55 | 0.55 | 0 | 0 | 0.275 | 0.275 | |
| Mo Dithiocarbamate | 0.20 | 0.20 | 0.20 | 0.20 | 0.2 | 0.2 | |
| Duomeen TDO | 0 | 0 | 0.55 | 0.55 | 0.275 | 0.275 | |
| Change of Shore-A-Hardness Points | +1 | +1 | +7 | +7 | +4 | +5 | −5 to 5 |
| Change of Volume, % | +0.4 | +0.4 | +0.7 | +0.8 | +0.5 | +0.6 | 0 to 5.0 |
| Change of Tensile Strength, % | −30 | −26 | −62 | −60 | −54 | −54 | ≧−50 |
| Change of Elongation at Break, % | −28 | −28 | −55 | −53 | −50 | −44 | ≧−55 |

This Example shows that Fluid 3, Fluid 4, Fluid 5 and Fluid 6 containing the Duomeen TDO gave bad seal compatibility results despite their good HFRR results in Table 2.

What is claimed is:

1. A lubricating oil composition comprising about 70.4 wt % of a base oil having a viscosity index (VI) greater than about 80, a kinematic viscosity (Kv) at 100° C. of from about 2 $mm^2/s$ to about 50 $mm^2/s$, containing 90 wt % or more saturates, having less than about 5 ppm sulfur, and wherein the base oil consists essentially of an oil derived from a Fischer-Tropsch wax with the proviso that the base oil does not include a polyalphaolefin fluid, and (a) about 0.55 wt % based on the total weight of the composition of a polyol ester consisting essentially of glycerol mono-octadecanoate and (b) about 0.2 wt % based on the total weight of the composition of an oil soluble or oil dispersible dinuclear molybdenum dithiocarbamate compound, and wherein said composition is free of N-tallow-1,3-diaminopropane dioleate, and (c) about 29 wt % of conventional additives chosen from dispersants, detergents, antioxidants, pour point depressants, VI improvers, rust inhibitors and antifoamants, whereby said composition has improved elastomer compatibility as evidenced by the DC AK6 seal compatibility test and improved friction reduction performance as evidenced by the High Frequency Reciprocating Rig Test when compared to a lubricant composition formulated with a base oil other than a base oil consisting of one derived from a waxy feed but having the same additive.

2. The composition of claim 1 wherein the composition has an increased film thickness and lower friction coefficient compared with a composition prepared from a base oil consisting of a polyolefin and (a) and (b) and (c).

3. In the method of lubricating an engine with a lubricating oil composition, the improvement comprising using a lubricating oil composition comprising about 70.4 wt % of a base oil having a viscosity index (VI) greater than about 120, a kinematic viscosity (Kv) at 100° C. of from about 2 $mm^2/s$ to about 50 $mm^2/s$, containing 95 wt % or more saturates, having less than about 5 ppm sulfur, and wherein the base oil consists essentially of an oil derived from a Fischer-Tropsch wax with the proviso that the base oil does not include a polyalphaolefin fluid; and (a) about 0.55 wt % of a polyol ester consisting essentially of glycerol mono-octadecanoate, and (b) about 0.2 wt % of an oil soluble or oil dispersible dinuclear molybdenum dithiocarbamate compound; and wherein said composition is free of N-tallow-1,3-diaminopropane dioleate, and (c) about 29 wt % of conventional additives chosen from dispersants, detergents, antioxidants, pour point depressants, VI improvers, rust inhibitors and antifoamants, whereby engine friction is reduced as evidenced by the High Frequency Reciprocating Rig Test while maintaining elastomer compatibility as evidenced by the DC AK6 seal compatibility test compared to a lubricating composition prepared from a base oil consisting of a poly olefin oil and (a) and (b).

* * * * *